US009598859B2

(12) United States Patent
Ddamulira et al.

(10) Patent No.: US 9,598,859 B2
(45) Date of Patent: Mar. 21, 2017

(54) SOUND REDUCING UNDERLAYMENT COMPOSITION, SYSTEM AND METHOD

(71) Applicant: W. F. Taylor Co., Inc., Fontana, CA (US)

(72) Inventors: Robert Kintu Ddamulira, Chattanooga, TN (US); Akbar Ghaneh-Fard, Dalton, GA (US)

(73) Assignee: W.F. Taylor LLC, Dalton, GA (US)

( * ) Notice: Subject to any disclaimer, the term of this patent is extended or adjusted under 35 U.S.C. 154(b) by 0 days.

(21) Appl. No.: 14/996,824

(22) Filed: Jan. 15, 2016

(65) Prior Publication Data

US 2016/0208482 A1 Jul. 21, 2016

Related U.S. Application Data

(60) Provisional application No. 62/104,461, filed on Jan. 16, 2015.

(51) Int. Cl.

| | |
|---|---|
| ***E04F 15/12*** | (2006.01) |
| ***E04B 1/84*** | (2006.01) |
| ***E04C 2/28*** | (2006.01) |
| ***E04C 2/284*** | (2006.01) |
| ***E04F 15/02*** | (2006.01) |
| ***E04F 15/10*** | (2006.01) |
| ***E04F 15/20*** | (2006.01) |

(52) U.S. Cl.

CPC ..... *E04B 1/8409* (2013.01); *E04C 2/28* (2013.01); *E04C 2/284* (2013.01); *E04F 15/0215* (2013.01); *E04F 15/102* (2013.01); *E04F 15/107* (2013.01); *E04F 15/12* (2013.01); *E04F 15/203* (2013.01)

(58) Field of Classification Search

CPC .... E04B 1/8409; E04C 2/284; E04F 15/0215; E04F 15/107

USPC ..... 181/286

See application file for complete search history.

(56) References Cited

U.S. PATENT DOCUMENTS

| | | | | |
|---|---|---|---|---|
| 4,504,628 | A | 3/1985 | Johnson | |
| 8,066,097 | B2 * | 11/2011 | Boyadjian | E04F 13/08 181/285 |
| 8,678,133 | B2 * | 3/2014 | Clausi | B32B 25/14 156/60 |
| 2004/0235379 | A1 | 11/2004 | Ahluwalia et al. | |
| 2005/0281997 | A1 | 12/2005 | Grah | |
| 2006/0128919 | A1 | 6/2006 | Okamoto et al. | |
| 2009/0029042 | A1 * | 1/2009 | Johnston | C04B 41/009 427/140 |
| 2009/0264612 | A1 | 10/2009 | Stanjek et al. | |
| 2010/0294676 | A1 * | 11/2010 | Grun | C04B 26/06 206/223 |
| 2011/0130062 | A1 * | 6/2011 | Squires | B32B 7/02 442/327 |
| 2011/0146762 | A1 | 6/2011 | Temchenko et al. | |
| 2011/0197543 | A1 * | 8/2011 | Lee | B32B 5/18 52/745.05 |
| 2014/0162075 | A1 * | 6/2014 | Kipp | C04B 28/26 428/449 |

OTHER PUBLICATIONS

International Search Report and Written Opinion issued on Mar. 29, 2016 in International Application No. PCT/US2016/013633.

* cited by examiner

*Primary Examiner* — Forrest M Phillips

(74) *Attorney, Agent, or Firm* — Stroock & Stroock & Lavan LLP

(57) ABSTRACT

An underlayment layer composition and flooring system, method of using the composition and method of obtaining desirable sound reducing results are provided. The underlayer can provide sound reducing properties. The underlayer material is preferably provided as a liquid or paste. It can take the form of a trowel applied, rapid curing material suitable for many floor systems. In preferred embodiments of the invention, a layer membrane of the material can help lead to an ASTM E492/ASTM E-986-06 impact sound transmission IIC rating or ASTM E90-04/E413-10 sound transmission loss STC rating of about 45 dB or greater, preferably over 65 dB and even over 69 dB.

44 Claims, No Drawings

SOUND REDUCING UNDERLAYMENT COMPOSITION, SYSTEM AND METHOD

CROSS-REFERENCE TO RELATED APPLICATIONS

This application claims priority to Provisional Application No. 62/104,461, filed Jan. 16, 2015, the contents of which is hereby incorporated by reference in its entirety.

BACKGROUND OF THE INVENTION

The invention relates generally to underlayment compositions and constructions and methods for reducing sounds transmission, particularly through flooring systems.

Sound rated or floating floor systems can be used in locations where it is desirable to decrease noise transmission, such as noise caused by sound vibration that travels from one area to another or impacts such as pedestrian footfalls, sports activities, dropping of toys, and/or scraping caused by moving furniture.

Sound insulation between, e.g., living areas in multi-family or single-family dwellings, is an important issue for the floor covering industry. When evaluating flooring underlayment for sound deadening characteristics; acoustical consultants, architects/specifiers and others often rely on sound testing to define the performance of a floor, ceiling or other assemblies and determine how well they insulate against noise created by impact and by airborne and other vibrations.

At least two types of laboratory sound tests performed in a controlled environment are recognized by the International Building Code (IBC) for sound vibration that travels from one living area to another: Impact Insulation Class (IIC) and Sound Transmission Class (STC). IIC tests the ability to block impact sound by measuring the resistance to transmission of impact noise or structure-borne noise (simulating footfalls, objects dropped on the floor, etc.). STC evaluates the ability of a specific construction assembly to reduce airborne sounds, such as voices, stereo systems, and TV. Both tests involve a standardized noise making apparatus in an upper chamber and a sound measuring system in a lower chamber. Decibel measurements are taken at various specified frequencies in the lower chamber. Those readings are then mathematically combined to create a whole number representation value of the test. The higher the number, the higher the resistance to sound transmission.

Non-laboratory, "field" tests for impact sound (FIIC) and for airborne sound (FSTC) are also recognized by the International Building Code. These sound tests can utilize the same or similar testing methods as IIC and STC, but are conducted in an actual building after the floor installation is completed.

Improved materials, systems and methods for reducing sound transmission and producing sound rated floors and flooring installations and systems with improved noise reduction and/or other advantages are desirable.

SUMMARY OF THE INVENTION

Generally speaking, in accordance with the invention, a material, system and method of using the material and system and method of obtaining desirable sound reduction and other results are provided. The invention is related to a sound reducing underlayment material. The material is preferably provided as a liquid or paste patch and leveler form. It can take the form of a trowel applied, rapid curing material that is suitable for many, if not most, floor systems (e.g., vinyl tile/plank, laminate, and wood). In preferred embodiments of the invention, a 3/32 inch layer of the material is capable of helping to lead to an ASTM E492/ASTM E-986-06 impact sound transmission rating of about IIC 45 or greater, preferably at least about 50, more preferably at least about 60 and most preferably, about 69 or greater and/or an ASTM E90-04/E413-10 sound transmission loss rating of about STC 45 or greater, preferably at least about 50, more preferably at least about 60 and most preferably, about 66 or greater.

The cured underlayment material preferably can also act as a moisture inhibitor. It can also be formulated to perform in high humidity. For example, it can be formulated to inhibit/reduce moisture of up to about 6, preferably about 8 and more preferably about 10 lbs/1000 sq. ft./24 hrs. at 90% relative humidity (ASTM F2170) to acceptable levels (e.g., under about 5, more preferably about 3 lbs/1000 sq. ft./24 hrs.) while still functioning properly. In regards to a relative humidity of up to 90%, the product can perform under these high humidity conditions without any significant problems and can be formulated to endure even higher humidity. Compositions in accordance with preferred embodiments of the invention can patch and level sub-flooring imperfections, advantageously up to 1/8 inch depth in 10 $ft^2$ area. It can act as a crack isolation membrane for cracks up to 1/8 inch wide and even wider. (ANSI A118.12 Crack Isolation "high performance classification"). Sound reducing layers and materials, in accordance with preferred embodiment of the invention, may also be used under ceramic tile mortar and grout installations.

Compositions in accordance with preferred embodiment of the invention, may be applied with trowels or metering devices. Other methods known in the art to provide application in a desired thickness are also acceptable. A sound reducing layer material in accordance with preferred embodiment of the invention is preferably moisture, air, light, pressure or otherwise cured in manners known in the art. One component curing systems and moisture curing systems are preferred.

Materials and methods in accordance preferred embodiment of the invention can provide a competitive installation alternative to rolled acoustic and moisture barrier underlayments. Floors, such as floating floors or adhered floors of all types may be assembled within an hour of application. The product is an excellent choice for multi-story installations where sound impacts rooms below and reduces underfoot noise when used with floating floors.

A flooring system in accordance with the invention can include (1) a sub-floor, such as a cement or plywood subfloor; (2) a top floor, such as wood, tile or sheet flooring; and (3) a sound reducing interlayer. The interlayer (underlayment) is advantageously formed with spheres (preferably microspheres) of effective proportions and constructions to provide the desired level of sound reduction. Preferred spheres are hollow and formed of glass or hard polymer, such as acrylic-type plastic materials. Other spheres are solid or have a foam-like interior within a shell and are therefore effectively hollow, in that their interior is not solid. The hardness of the interlayer and the rigidity of the spheres should be selected to prevent the spheres from being crushed during use. The amount of spheres per micron of layer thickness can be regulated by adjusting the percentage of spheres in the formulation and the viscosity of the formulation, so as to adjust the final interlayer thickness.

The product is an excellent choice for multi-story installations where sound impacts rooms below and reduces underfoot noise when used with floating floors.

Additional features and advantages of the product, system and method in accordance with the preferred embodiments of the invention are described and will be evident from the descriptions below. This summary section is meant merely to illustrate certain features of the invention, and is not meant to limit the scope of the invention in any way. The failure to discuss a specific feature or embodiment of the invention, or the inclusion of one or more features in this summary section, should not be construed to limit the invention.

DETAILED DESCRIPTION OF PREFERRED EMBODIMENTS

Impact noise generation on floors can be reduced by using thick carpeting. However, where vinyl, linoleum, tile, hardwood, laminates and other types of hard surfaces, including decorated concrete finishes are to be used, it is often desirable to take measures to provide a sound rated floor. Such floor may be required by codes for acoustical separation of multifamily units.

Sound rated floors are typically evaluated by American Society for Testing and Materials (ASTM) Standards E90 for Sound Transmission Class (STC) ratings and E492 with respect to Impact Insulation Class (IIC). The greater the IIC rating, the less impact noise will be transmitted to the area below. The greater the STC rating, the less airborne sound will be transmitted to the area below.

The transmission of floor impact noise to the area below can be significantly reduced by resiliently supporting or acoustically decoupling and/or dampening the underlayment floor away from the floor substructure.

The entire floor system contributes to transmitting the noise into the area below. If the floor surface receiving the impact is isolated from the substructure, then the sound transmission can be significantly reduced. A dampening material can also reduce transmitted noise. Likewise, if the ceiling below is isolated from the substructure, the impact sound will be restricted from traveling into the area below.

Conventional flooring systems typically include a subfloor (e.g., of poured concrete or plywood) and a finished floor (e.g., ceramic tile, vinyl tile, laminate or hardwood). Such systems may also employ poured or otherwise deposited underlayment layer located between the finished floor and the subfloor, typically for providing a smooth, monolithic substrate for the finished floor and providing a flooring assembly system.

Compositions, materials and systems in accordance with the present invention can provide, in various embodiments, a sound reducing underlayment, which can also function as a patch and leveler (referred to herein as the sound reducing layer, underlayer, underlayment or interlayer) that can reduce sound transmission (e.g., more than about 45, preferably over about 50 or 60 and up to or better than about IIC 71 dB and STC 67 dB). With selected flooring, these numbers can be higher. When properly formulated, the sound reducing layer/interlayer can also provide one or more of the following advantages:

- Control moisture vapor transmission (e.g., up to or over about 6, preferably more than about 8 and more preferably more than about 10 pounds per 1000 square feet per 24 hours—ASTM 1869 to below 5, preferably 3 pounds per 1000 square feet);
- Achieve extremely low permeability ratings;
- Level and/or patch uneven subfloors;
- Act as crack isolation membrane; and/or
- Enhance thermal insulating properties of the floor, e.g. R values of up to at least about 4, and potentially at least 10 per inch and total R values of at least about 4, preferably at least about 8 and more preferably at least about 10 and even higher.

The sound reducing layer can be an improved replacement for rolled sound reducing membranes, with its easy installation and short (e.g., one hour) set-up time and enhanced properties. When fully cured, it can provide a sealed, leveled, and flat membrane layer. Over time, rolled membranes tend to break down due to traffic. Sound reducing layers in accordance with the invention can be more durable.

Installing the sound reducing layer can be simple. Advantageously, it is formulated to be unaffected by concrete slab alkalinity, can be installed on porous or non-porous surfaces, and can have extremely low permeability ratings. As the product cures, it can be formulated to use a formulated cross-linking modified silane polymer-base to build a tenacious but elastic resilient membrane.

The sound reducing layer material can be formulated to be free of solvents, hazardous chemicals (per OSHA Regulation CFR 1910.1200), water, and isocyanates. In preferred embodiments, the product can be a one component, 100% solids, non-flammable and low odor liquid underlayment. It can be formulated to have negligible volatile organic compound (VOC) content and meet federal, state, and local governmental indoor air quality regulations. It can be formulated to achieve the UL GREENGUARD Certification for low chemical emissions (UL 2818-2013 Standard for Chemical Emissions for Building Materials, Finishes and Furnishings; see, e.g., UL.COM/GG).

In certain preferred embodiments, the sound reducing layer material can be formulated as shown in Table 1. All amounts herein are given in percent by weight of the uncured material. However, sound reduction properties will be for the cured material. As will be evident to those of ordinary skill in the art, substitutions, omissions and additions will be possible in order to provide underlayments with customized selected properties.

TABLE 1

| | Ingredient | Preferred Range | More Preferred Range |
|---|---|---|---|
| 1 | Moisture Cured Polymer System | 15-50% | 25-35% |
| 2 | Plasticizer | 15-50% | 15-35% |
| 3 | Antioxidant and/or Light Stabilizer | 0.10-0.30% | 0.15-0.25% |
| 4 | Biocide and/or Fungicide | 0.01-0.08% | 0.03-0.06% |
| 5 | Filler | 20-60% | 30-50% |
| 6 | Spheres or Microspheres | 0.20-5.0% | 0.40-3.0% |
| 7 | Moisture Scavenger | 1.0-8.0% | 3.0-6.0% |
| 8 | Adhesion Promoter | 1.0-6.0% | 1.5-3.0% |
| 9 | Catalyst | 0.05-0.80% | 0.05-0.80% |

Exemplary Moisture Cured Polymer Systems include, but are not limited to, Silane Terminated Prepolymers (e.g., Kaneka MS Polymer, Wacker Genosil Silane Modified Polymer, Momentive SPUR Hybrid Polymer) and Polyurethane Prepolymers.

Exemplary Plasticizers include, but are not limited to, Petroleum Based Oils, Plant Based Oils, Animal and Marine Oils, and Synthetic Oils. For example, in various embodiments, the Plasticizer may comprise Polyproplylene Glycol, Pthalates and Benzoate Ester-Type Plasticizers.

Various examples of Antioxidants, Light Stabilizers, Biocides, and Fungicides are known to those of ordinary skill in the art and may be included.

Various Fillers, usually 20-60%, more preferably 30% to 50%, may be used, which are known to those of ordinary skill in the art, such as, but not limited to, Calcium Carbonate, Kaolin Clay, Mica, Talc and Silica can be advantageously employed.

In a preferred embodiment of the invention, the microspheres are substantially hollow microspheres, with diameters in the micrometer range (e.g., 10 μm to 200 μm, more preferably 30 μm to 100 μm). Microspheres can be manufactured from various natural and synthetic materials and need not be entirely hollow, as long as the majority of the interior volume is hollow. Exemplary microspheres include, but are not limited to, glass microspheres, polymer microspheres, and ceramic microspheres. Suitable microspheres include Exapncel brand microspheres, available from AkzoNobel of Duluth, Ga.

Various Moisture Scavengers may be used, which are known to those of ordinary skill in the art, such as, but not limited to, Vinyl Trimethoxy Silanes.

Various Adhesion Promoters may be used, which are known to those of ordinary skill in the art, such as, but not limited to, Amino Silanes.

Various Catalysts may be used, which are known to those of ordinary skill in the art, such as, but not limited to, Dibutyltin Dilaurate.

EXAMPLES

Preferred embodiments of the invention will be explained with reference to the following examples, which are provided for purposes of illustration only and are not intended to be construed as limiting. The composition tested is in accordance with preferred embodiments of the invention.

Four non-limiting example compositions are shown in Table 2.

TABLE 2

| | Ingredient | Example 1 | Example 2 | Example 3 | Example 4 |
|---|---|---|---|---|---|
| 1 | Moisture Cured Polymer System | 40.00% | 22.62% | 15.13% | 30.00% |
| 2 | Plasticizer | 15.40% | 20.00% | 29.50% | 34.00% |
| 3 | Antioxidant and/or Light Stabilizer | 0.200% | 0.300% | 0.300% | 0.300% |
| 4 | Biocide and/or Fungicide | 0.040% | 0.080% | 0.070% | 0.070% |
| 5 | Filler | 40.00% | 50.00% | 43.00% | 23.83% |
| 6 | Microspheres | 0.600% | 2.000% | 4.500% | 5.000% |
| 7 | Moisture Scavenger | 2.000% | 3.000% | 4.000% | 3.500% |
| 8 | Adhesion Promoter | 1.560% | 2.000% | 3.000% | 1.500% |
| 9 | Catalyst | 0.200% | 0.600% | 0.500% | 0.800% |

When an effective amount of microspheres of appropriate density, composition and construction are employed in a suitable formulation, effective acoustic improvement of a flooring system can be obtained. Hollow spheres made of glass, acrylic (e.g., acrylonitrile), etc.—though hard, exhibit resiliency and can absorb sound. Thus, underlayments formulated with effective amounts of microspheres of suitable size and composition in a suitably formulated layer can significantly reduce sound transmission in flooring assemblies.

The composition of the shell and the size of the microspheres can be selected to provide various desired properties. For example, for smooth surfaces, smaller particle sizes are preferred. Preferably, the microspheres should be selected to withstand shear in processing and can withstand specific chemical and physical reactions. The microspheres used in the present invention are preferably stable during the manufacturing process, the curing process, and the lifetime of the flooring installation.

Sound reducing layer materials in accordance with preferred embodiments of the invention, can advantageously be formulated to be used over APA grade underlayment plywood, flooring grade particleboard, OSB, cork underlayment, existing well bonded non-cushioned resilient flooring, terrazzo, cementitious and anhydrite screeds, concrete, radiant heated subfloors and other flooring type. Preferably the radiant heated surfaces do not exceed 85° F. (30° C.). These sound reducing layers can be installed above, on, or below grade, in the absence of excessive moisture. While this barrier can be formulated to be waterproof when cured, the installation should preferably be protected from excessive moisture.

The sound reducing layers, in accordance with preferred embodiments of the invention, can be applied with a trowel or similar instrument for self-leveling. The moisture content should be within the flooring manufacturer's guidelines for allowable levels of moisture.

Trowel recommendations are shown in Table 3. Liquid underlayment coverage is approximate and can vary depending on the porosity and roughness of subfloor, angle at which the trowel is held, temperature or the liquid underlayment and subfloor, and the skill of the installer applying the liquid underlayment. The liquid underlayment coverage can be improved by priming the subfloor to reduce absorption of the liquid underlayment into the subfloor. The underlayment coverage could be significantly lower over subfloors not properly prepared according to established industry guidelines.

TABLE 3

| Application | Trowel Size* and Notch | Coverage |
|---|---|---|
| For sound reducing underlayment, moisture barrier, and filling cracks up to 1/8" wide: | 1/16" × 1/16 × 3/32 U-notch 1.6 mm × 1.6 mm × 2.4 mm | 100 sq. ft/gal 2.5 sq. meters/liter |
| For sound reducing underlayment, moisture barrier, filling cracks up to 1/8" wide, patching and leveling uneven floors up to 1/8" depth in 10 feet: | 3/16" × 5/32" Saw tooth 4.8 mm × 4.0 mm | 60 sq. ft./gal 1.5 sq. meters/liter |

*Trowel dimension is width × depth × spacing.

The substrate should be sound, smooth, clean, level, dry. It should be free of dust, dirt and grease. It can be advantageous if it is free of oil, paint, curing compounds, incompatible sealers, fire retardant chemicals, release agents, or any other foreign substance that might interfere with a good bond. The subfloor should be smooth and fully adhered. Depending on the type and condition of the subfloor, mechanical treatment of the subfloor such as mechanical brushing, grinding with coarse sand paper, milling or ball blasting may be advantageous. The installer should ensure that a concrete surface is properly prepared prior to installation.

In certain embodiments of the invention, installation of the product can proceed as follows. The sound reducing layer material, floor covering, and areas to receive flooring are preferably maintained at a temperature of 65°-95° F. (18°-35° C.) and at a relative humidity of 30%-60% for at least 72 hours before, during, and after installation. Follow the flooring manufacturer's guidelines regarding site conditions, layout, and installation. Apply the sound reducing layer material with the recommended trowel and allow to cure for typically one hour or until the barrier is dry to the touch before installing the floor, such as the floating floor system. The drying time will vary with ambient job site conditions. The should be installed according to the manufacturer's installation guidelines for their floating floor systems. For clean-up, use a solvent-based adhesive remover/stripper that is compatible with the flooring manufacturer's finish.

In various embodiments, the properties of the sound reducing layer can include one or more of the following:

- Base: Modified silane polymer blend;
- Appearance: White to beige, smooth, creamy, easy to trowel;
- Working time: 30 minutes depending on temperature and humidity;
- Shelf life: One year in unopened container at 70° F. (21.10° C.).

In various embodiments of the invention, other features of the sound reducing layer include one or more of the following:

- Provides sound reduction, moisture inhibition, crack isolation, and enhances thermal insulation;
- VOC compliant, nonflammable, and freeze/thaw stable to 10° F. (−12° C.);
- Made with anti-microbial agents that will provide its dry film with protection from fungal growth (protection determined using the ASTM G21 test method).

Table 4 shows the GREENGUARD Certification Criteria for Building Products and Interior Finishes, which, certain formulation of the sound reducing layer material have been found to meet.

TABLE 4

| Criteria | CAS Number | Maximum Allowable Predicted Concentration | Units |
|---|---|---|---|
| $TVOC_{(A)}$ | — | 0.50 | $mg/m^3$ |
| Formaldehyde | 50-00-0 | 61.3 (50 ppb) | $\mu g/m^3$ |
| Total $Aldehydes_{(B)}$ | — | 0.10 | ppm |
| Particle Matter less than 10 μm $_{(C)}$ | — | 50 | $\mu g/m^3$ |
| 4-Phenylcyclohexene | 4994-16-5 | 6-5 | $\mu g/m^3$ |
| Individual $VOCs_{(D)}$ | — | 1/10th TLV | — |

In Table 4, footnotes are as follows: (A) Defined to be the total response of measured VOCs falling within the C6-C16 range, with responses calibrated to a toluene surrogate. (B) The sum of all measured normal aldehydes from formaldehyde through nonanal, plus benzaldehyde, individually calibrated to a compound specific standard. Heptanal through nonanal are measured via TD/GC/MS analysis and the remaining aldehydes are measured using HPLC/UV. (C) Particle emission requirement only applicable to HVAC Duct Products with exposed surface area in air streams (a forced air test with specific test method) and for wood finishing (sanding) systems analysis. (D) Allowable levels for chemicals not listed are derived from 1/10th of the Threshold Limit Value (TLV) industrial work place standard (Reference: American Conference of Government Industrial Hygienists, 6500 Glenway, Building D-7, and Cincinnati, Ohio 45211-4438).

Examples 5-7

These Examples 5, 6, and 7 conform with American Society for Testing and Materials (ASTM) Standard Test Method for Laboratory Measurement of Sound Transmission Through Floor-Ceiling Assemblies Using a Tapping Machine (Impact Sound Transmission Test)—Designation: E 492-09/E 989-06

Approximate Specimen Description: 6 inch concrete slab floor-suspended ceiling assembly overlaid with vinyl (LVT) flooring, floating on sound reducing underlayment constructed in accordance with the invention. The test specimen of Example 5 was a floor-suspended ceiling assembly, with all weights and dimensions averaged. Example 6 has no flooring on the underlayment layer and Example 7 has a wood floor:

One layer of Shaw Resilient LVT flooring. Measured dimensions: 6 in×48 in (152.4 mm×1219.2 mm). The LVT flooring was floating on sound reducing underlayment in accordance with the invention. The average thickness: 1/8 inch (3.12 mm). The measured weight of the LVT: 6.00 $kg/m^2$ (1.23 PSF)

One 3/32 inch layer of sound reducing underlayment in accordance with the invention, applied to the concrete slab with a 3/32 in.×3/32 in.×3/32 in. (2.38 mm×2.38 mm×2.38 mm) trowel.

One 6 inch (152.4 mm) thick reinforced concrete slab, weighing: 366.2 $kg/m^2$ (75.0 PSF).

One layer of 3.5 inch (88.9 mm) unfaced fiberglass batt insulation which was laid over a suspended grid system parallel to the main tees. Sample weight: 0.78 $kg/m^2$ (0.16 PSF).

Gypsum wallboard ceiling grid suspension system, comprised of main tees and cross tees. The main tees were placed 48 inch (1219.2 mm) o.c. and the cross tees were placed 24 inch (609.6 mm) o.c. 16 gauge galvanized tie wire was used to attach the main tees to concrete anchors, located 48 inch (1219.2 mm) o.c. along the longitudinal axis, suspending the grid 12 inch (304.8 mm) below the concrete slab.

One layer of ⅝ inch (15.9 mm) Type X gypsum wallboard. The wallboard was attached parallel to the suspended grid suspension system mains, using 1⅛ inch (28.6 mm) Type S drywall screws spaced 12 inch (304.8 mm) o.c. The wallboard joints were taped. Suspended gypsum wallboard grid ceiling weighted: 11.23 kg/m$^2$ (2.3 PSF)

The overall weight of the test assembly was: 384.17 kg/m$^2$ (78.69 PSF). The perimeter of the test frame was sealed with a rubber gasket and a sand filled trough. The test frame was structurally isolated from the receiving room.

Specimen size: 12 ft×16 ft (3657.6 mm×4876.8 mm). Conditioning: Concrete slab cured for a minimum of 28 days. Underlayment cured for a minimum of 3 days.

With the above (vinyl floor) or substantially similar (e.g. wood or just the underlayment) protocol, the following results were obtained:

Impact Insulation Class IIC Values for Example 5: 69 dB (vinyl); Example 6: 69 dB (freestanding underlayment); Example 7: 71 dB (laminate wood).

Examples 8-10

These examples 8, 9 and 10 conform with the ASTM Standard Test Method for Laboratory Measurement of Airborne Sound Transmission Loss of Building Partitions and Elements—Designation: E 90-04/E 413-10.

Approximate Specimen Description: 6 inch concrete slab floor-suspended ceiling assembly overlaid with a sound reducing layer liquid-based underlayment in accordance with the invention. The test specimen was a floor-suspended ceiling assembly and consisted of (all weights and dimension are averaged). Example 8 is underlayment only. Example 9 adds a wood floor and Example 10 adds a vinyl floor.

One layer of, a sound reducing layer liquid-based underlayment in accordance with the invention, applied to the concrete slab with a 3⁄32 in. ×3⁄32 in.×3⁄32 in. (2.38 mm×2.38 mm×2.38 mm) trowel to a thickness of about 3⁄32 inch.

One 6 inch (152.4 mm) thick reinforced concrete slab, weighing: 366.2 kg/m2 (75.0 PSF).

One layer of 3.5 inch (88.9 mm) unfaced fiberglass batt insulation which was laid over a suspended grid system parallel to the main tees. Sample weight: 0.78 kg/m2 (0.16 PSF).

Gypsum wallboard ceiling grid suspension system, comprised of main tees and cross tees. The main tees were placed 48 inch (1219.2 mm) o.c. and the cross tees were placed 24 inch (609.6 mm) o.c. 16 gauge galvanized tie wire was used to attach the main tees to concrete anchors, located 48 inch (1219.2 mm) o.c. along the longitudinal axis, suspending the grid 12 inch (304.8 mm) below the concrete slab.

One layer of ⅝ inch (15.9 mm) Type X gypsum wallboard. The wallboard was attached parallel to the suspended grid suspension system mains, using 1⅛ inch (28.6 mm) Type S drywall screws spaced 12 inch (304.8 mm) o.c. The wallboard joints were taped. Suspended gypsum wallboard grid ceiling weighted: 11.23 kg/m$^2$ (2.3 PSF)

The overall weight of the test assembly is: 378.16 kg/m$^2$ (77.46 PSF). The perimeter of the test frame was sealed with a rubber gasket and a sand filled trough. The test frame was structurally isolated from the receiving room. Specimen size: 12ft.×16ft. (3657.6 mm×4876.8 mm).

Conditioning: Concrete slab cured for a minimum of 28 days. Underlayment cured for a minimum of 3 days.

Sound Transmission Class STC: Example 8: 66 dB (freestanding underlayment); Example 9: 66 dB (wood laminate floor); Example 10: 67 dB (vinyl floor).

While there have been shown and described fundamental features of the invention as applied to the preferred and exemplary embodiments thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. Hence, it is not desired to limit the invention to the exact construction and operation shown and described and, accordingly, all suitable modification equivalents may be resorted to falling within the scope of the invention as claimed. It is the intention, therefore, to be limited only as indicated by the scope of the claims appended hereto.

What is claimed is:

1. A flooring system assembled at a flooring installation site, including a sound reducing underlayment material, comprising a sub-floor, adapted to have a top-floor installed thereon;

a sound reducing interlayer comprising a curable or cured polymer base with hollow microspheres dispersed therein, to reduce sound transmission through the flooring system, the hollow microspheres having a diameter of about 10 μm to about 200 μm and comprising about 0.2% to about 5.0% by weight of the polymer material, formed by spreading the interlayer material from a bulk source into a layer over the sub-floor at the flooring installation site; and a top-floor, suitable to serve as the finished flooring installed over the interlayer at the flooring installation site.

2. The flooring system of claim 1, consisting essentially of the sub-floor, the interlayer and the top-floor.

3. The flooring system of claim 1, comprising interlayer means for reducing sound transmission through the flooring system.

4. The flooring system of claim 1, wherein the flooring system comprises a cured 3⁄32 inch layer of the interlayer and has the structural sound insulating properties to achieve an Impact Insulation Class (IIC) value of at least 50 dB when tested under ASTM E 492-09/ASTM E 989-06 or a Sound Transmission Class (STC) value of at least 50 dB, when tested under ASTM E 90-04/ASTM E 413-10.

5. The flooring system of claim 1, wherein the interlayer material comprises about 0.4%-3.0% hollow microspheres.

6. The flooring system of claim 4, wherein the polymer base comprises at least one of a silane terminated prepolymer and a polyurethane prepolymer.

7. The flooring system of claim 4, wherein the polymer base comprises an alkoxy silane terminated prepolymer.

8. The flooring system material of claim 4, wherein the polymer base comprises about 15% to about 50% by weight of the interlayer material.

9. The flooring system of claim 4, wherein the polymer base comprises about 25% to about 35% by weight of the interlayer material.

10. The flooring system of claim 4, wherein the hollow microspheres comprise at least one of glass microspheres, polymer microspheres, or ceramic microspheres.

11. The flooring system of claim 1, wherein the interlayer material comprises about 15%-50% moisture curable polymer system and about 20%-60% filler.

12. The flooring system of claim 1, wherein the interlayer material comprises about 25%-35% moisture curable polymer system and about 30%-50% filler.

13. The flooring system of claim 11, wherein the interlayer material comprises about 0.10% to about 0.30% by weight of a an antioxidant/light stabilizer.

14. The flooring system of claim 4, wherein the interlayer material comprises about 25%-35% polymer base and about 30%-50% filler.

15. The flooring system of claim 11, wherein the interlayer material comprises an amino silane adhesion promoter.

16. The flooring system of claim 11, wherein the interlayer material comprises a dibutyltin dilaurate catalyst.

17. The flooring system of claim 1, comprising a cured 3/32 inch interlayer and the system having the structural sound insulating properties to achieve an Impact Insulation Class (IIC) of at least 60 dB when tested under ASTM E 492-09/ASTM E 989-06 or a Sound Transmission Class (STC) of at least 60 dB, when tested under ASTM E 90-04/ASTM E 413-10.

18. The flooring system of claim 1, comprising a cured 3/32 inch interlayer and the system having the structural sound insulating properties to achieve an Impact Insulation Class (IIC) of at least 65 dB when tested under ASTM E 492-09/ASTM E 989-06 or a Sound Transmission Class (STC) of at least 65 dB, when tested under ASTM E 90-04/ASTM E 413-10.

19. The flooring system of claim 4, wherein the interlayer, when cured, can reduce moisture vapor transmission of at least 8 pounds per 1000 square feet per 24 hours and 90% relative humidity to under 5 pounds per 1000 square feet per 24 hours.

20. A method of installing a sound reducing flooring system over an existing sub-floor substrate at a flooring installation site, comprising providing at the flooring installation site, a bulk source of a sound reducing liquid or paste interlayer material comprising a curable polymer base with hollow microspheres dispersed therein, the hollow microspheres having a diameter of about 10 μm to about 200 μm and comprising about 0.20% to about 5.0% by weight of the interlayer;

spreading the interlayer material over the sub-floor to form a layer of interlayer material; permitting the interlayer material to cure; and installing a finished floor over the layer of interlayer material.

21. The method of claim 20, consisting essentially of spreading the interlayer material over the sub-floor, permitting the interlayer material to cure and installing the finished floor over the interlayer material.

22. The method of claim 20, comprising forming interlayer means, for reducing sound transmission through the flooring system.

23. The method of claim 20, wherein the interlayer material is spread with a trowel.

24. The method of claim 20, wherein, the interlayer material is formulated and applied in a manner adapted to provide a cured 3/32 inch layer that has the structural sound insulating properties for the finished flooring system to achieve an Impact Insulation Class (IIC) value of at least 50 dB when tested under ASTM E 492-09/ASTM E 989-06 or a Sound Transmission Class (STC) value of at least 50 dB, when tested under ASTM E 90-04/ASTM E 413-10.

25. The method of claim 20, wherein the interlayer material comprises about 0.4%-3.0% hollow microspheres.

26. The method of claim 20, wherein, the interlayer material is formulated and applied in a manner adapted to provide a cured 3/32 inch layer that has the structural sound insulating properties for the finished flooring system to achieve an Impact Insulation Class (IIC) value of at least 60 dB when tested under ASTM E 492-09/ASTM E 989-06 or a Sound Transmission Class (STC) value of at least 60 dB, when tested under ASTM E 90-04/ASTM E 413-10.

27. The method of claim 20, wherein, interlayer material is formulated and applied in a manner to provide a cured 3/32 inch layer that has the structural sound insulating properties for the finished flooring system to achieve an Impact Insulation Class (IIC) value of at least 65 dB when tested under ASTM E 492-09/ASTM E 989-06 or a Sound Transmission Class (STC) value of at least 65 dB, when tested under ASTM E 90-04/ASTM E 413-10.

28. The method of claim 24, wherein the interlayer material layer comprises about 15%-50% moisture curable polymer system and about 30%-60% filler.

29. The method of claim 25, wherein the interlayer material layer comprises about 25%-35% moisture curable polymer system and about 30%-50% filler.

30. The method of claim 24, wherein the finished floor comprises a floating floor over the sub-floor or a floor system adhered in place over the sub-floor with a layer of adhesive.

31. A flooring system, assembled at a flooring installation site, comprising a subfloor, a finished floor and a sound reducing underlayment layer spread from a bulk source into a layer at the installation site between the finished floor and subfloor, the underlayment layer comprising a polymer base and hollow microspheres dispersed therein, the hollow microspheres having a diameter of about 10 μm to about 200 μm and comprising about 0.20% to about 5.0% by weight of the underlayment layer.

32. The flooring system of claim 31, wherein the underlayment layer has a construction such that a 3/32 inch layer of the underlayment has the sound insulating properties to achieve an Impact Insulation Class (IIC) value of at least 50 dB when tested under ASTM E 492-09/ASTM E 989-06 or a Sound Transmission Class (STC) value of at least 50 dB, when tested under ASTM E 90-04/ASTM E 413-10.

33. The flooring system of claim 31, wherein the underlayment layer has a construction such that a 3/32 inch layer of the underlayment has the sound insulating properties to achieve an Impact Insulation Class (IIC) value of at least 60 dB when tested under ASTM E 492-09/ASTM E 989-06 or a Sound Transmission Class (STC) value of at least 60 dB, when tested under ASTM E 90-04/ASTM E 413-10.

34. The flooring system of claim 31, wherein the underlayment layer has a construction such that a 3/32 inch layer of the underlayment has the sound insulating properties to achieve an Impact Insulation Class (IIC) value of at least 65 dB when tested under ASTM E 492-09/ASTM E 989-06 or a Sound Transmission Class (STC) value of at least 65 dB, when tested under ASTM E 90-04/ASTM E 413-10.

35. The flooring system of claim 31, wherein the hollow microspheres have a diameter of about 30-100 μm, and comprising about 25%-35% polymer system, 30%-50% filler and 0.4%-3.0% hollow microspheres.

36. The flooring system of claim 31, wherein the subfloor is cement or plywood and the finished floor comprises at least one of wood, tile or thin sheeting.

37. The flooring system of claim 31, wherein the finished floor is adhered with a layer of adhesive.

38. The flooring system of claim 31, wherein the underlayment layer can reduce moisture vapor transmission of at least 8 pounds per 1000 ft2 per 24 hours at 90% relative humidity to under 5 pound per 1000 ft2 per 24 hours.

39. The flooring system of claim 31, wherein the underlayment layer can reduce moisture vapor transmission of at least 10 pounds per 1000 ft2 per 24 hours at 90% relative humidity to under 5 pound per 1000 ft2 per 24 hours.

40. The flooring system of claim 39, wherein the moisture transmission can be reduced to below 3 lb per 1000 ft2 per 24 hours.

41. The flooring system of claim 34, wherein the hollow microspheres have a diameter of about 30-100 μm, and comprising about 25%-35% polymer system, 30%-50% filler and 0.4%-3.0% hollow microspheres.

42. The method of claim 29, wherein the interlayer material is spread with a trowel.

43. The method of claim 42, wherein the interlayer material is formulated and applied in a manner adapted to provide a cured 3/32 inch layer that has the structural sound insulating properties for the finished flooring system to achieve an Impact Insulation Class (IIC) value of at least 50 dB when tested under ASTM E 492-09/ASTM E 989-06 or a Sound Transmission Class (STC) value of at least 50 dB, when tested under ASTM E 90-04/ASTM E 413-10.

44. The method of claim 42, wherein the interlayer material is formulated and applied in a manner adapted to provide a cured 3/32 inch layer that has the structural sound insulating properties for the finished flooring system to achieve an Impact Insulation Class (IIC) value of at least 60 dB when tested under ASTM E 492-09/ASTM E 989-06 or a Sound Transmission Class (STC) value of at least 60 dB, when tested under ASTM E 90-04/ASTM E 413-10.

* * * * *